US010683469B2

(12) United States Patent
Backer et al.

(10) Patent No.: US 10,683,469 B2
(45) Date of Patent: Jun. 16, 2020

(54) ADDITIVE FOR REDUCING SPOTTING IN AUTOMATIC DISHWASHING SYSTEMS

(71) Applicants: Rohm and Haas Company, Collegeville, PA (US); Union Carbide Corporation, Seadrift, TX (US)

(72) Inventors: Scott Backer, Phoenixville, PA (US); Severine Ferrieux, Grasse (FR); Paul Mercando, Pennsburg, PA (US); Eric P. Wasserman, Collegeville, PA (US)

(73) Assignees: Rohm and Haas Company, Philadelphia, PA (US); Union Carbide Corporation, Midland, MI (US)

( * ) Notice: Subject to any disclaimer, the term of this patent is extended or adjusted under 35 U.S.C. 154(b) by 0 days.

(21) Appl. No.: 15/766,068

(22) PCT Filed: Sep. 27, 2016

(86) PCT No.: PCT/US2016/053862

§ 371 (c)(1),
(2) Date: Apr. 5, 2018

(87) PCT Pub. No.: WO2017/062222

PCT Pub. Date: Apr. 13, 2017

(65) Prior Publication Data

US 2018/0291313 A1 Oct. 11, 2018

(30) Foreign Application Priority Data

Oct. 9, 2015 (EP) ..... 15290257

(51) Int. Cl.
*C11D 1/00* (2006.01)
*C11D 3/37* (2006.01)

(52) U.S. Cl.
CPC ..... *C11D 3/3769* (2013.01); *C11D 3/378* (2013.01); *C11D 3/3757* (2013.01)

(58) Field of Classification Search
None
See application file for complete search history.

(56) References Cited

U.S. PATENT DOCUMENTS

| | | | | |
|---|---|---|---|---|
| 4,725,655 | A | 2/1988 | Denzinger et al. | |
| 6,172,027 | B1 * | 1/2001 | Boeckh | C08F 226/06 510/299 |
| 6,207,631 | B1 | 3/2001 | Kasturi et al. | |
| 9,670,435 | B2 * | 6/2017 | Detering | C11D 3/378 |
| 2002/0137649 | A1 | 9/2002 | Carnali et al. | |
| 2003/0158064 | A1 | 8/2003 | Kessler et al. | |
| 2009/0197791 | A1 * | 8/2009 | Balastre | A61K 8/8158 510/407 |
| 2010/0234264 | A1 | 9/2010 | Creamer et al. | |

FOREIGN PATENT DOCUMENTS

| | | | |
|---|---|---|---|
| EP | 56019 | A1 | 7/1982 |
| EP | 0560519 | A2 | 9/1993 |
| WO | 1999/27058 | A1 | 6/1999 |

* cited by examiner

*Primary Examiner* — Necholus Ogden, Jr.
(74) *Attorney, Agent, or Firm* — Kenneth Crimaldi

(57) ABSTRACT

A phosphorus-free automatic dishwashing detergent composition comprising 2.5 to 8 wt % of a first polymer comprising polymerized units of: (i) 55 to 85 wt % of a $C_3$-$C_6$ monoethylenically unsaturated carboxylic acid, (ii) 2 to 30 wt % of a $C_3$-$C_6$ monoethylenically unsaturated dicarboxylic acid and (iii) 2 to 15 wt % of a $C_5$-$C_{12}$ monoethylenically unsaturated tertiary amine; and having $M_w$ from 2,000 to 100,000.

5 Claims, No Drawings

ADDITIVE FOR REDUCING SPOTTING IN AUTOMATIC DISHWASHING SYSTEMS

BACKGROUND

This invention relates generally to a detergent composition useful in non-phosphate automatic dishwashing systems.

Automatic dishwashing detergents are generally recognized as a class of detergent compositions distinct from those used for fabric washing or water treatment. Automatic dishwashing detergents are required to produce a spotless and film-free appearance on washed items after a complete cleaning cycle. Phosphate-free compositions rely on non-phosphate builders, such as salts of citrate, carbonate, silicate, disilicate, bicarbonate, aminocarboxylates and others to sequester calcium and magnesium from hard water, and upon drying, leave an insoluble visible deposit. Polymers made from acrylic acid and 2-(dimethylamino)ethyl methacrylate (DMAEMA) are known for use in detergent formulations to increase suds volume, see for example, U.S. Pat. No. 6,207,631. However, this reference does not disclose the compositions of the present invention, which offer improved cleaning performance.

STATEMENT OF INVENTION

The present invention is directed to a phosphorus-free automatic dishwashing detergent composition comprising 2.5 to 8 wt % of a first polymer comprising polymerized units of: (i) 55 to 85 wt % of a $C_3$-$C_6$ monoethylenically unsaturated carboxylic acid, (ii) 2 to 30 wt % of a $C_3$-$C_6$ monoethylenically unsaturated dicarboxylic acid and (iii) 2 to 15 wt % of a $C_5$-$C_{12}$ monoethylenically unsaturated tertiary amine; and having $M_w$ from 2,000 to 100,000.

DETAILED DESCRIPTION

All percentages are weight percentages (wt %), and all temperatures are in ° C., unless otherwise indicated. Weight average molecular weights, $M_w$, are measured by gel permeation chromatography (GPC) using polyacrylic acid standards, as is known in the art. The techniques of GPC are discussed in detail in Modern Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. The molecular weights reported herein are in units of daltons. Monomer units listed as carboxylic or sulfonic acids may be in the acid and/or salt form depending on the pH of the environment. As used herein the term "(meth)acrylic" refers to acrylic or methacrylic; the term "carbonate" to alkali metal or ammonium salts of carbonate, bicarbonate, percarbonate, sesquicarbonate; the term "silicate" to alkali metal or ammonium salts of silicate, disilicate, metasilicate; and the term "citrate" to alkali metal citrates. Preferably, the carbonates, silicates or citrates are sodium, potassium or lithium salts; preferably sodium or potassium; preferably sodium. Weight percentages of carbonates or citrates are based on the actual weights of the salts, including metal ions. The term "phosphorus-free" refers to compositions containing less than 0.5 wt % phosphorus (as elemental phosphorus), preferably less than 0.2 wt %, preferably less than 0.1 wt %, preferably no detectable phosphorus. Weight percentages in the detergent composition are percentages of dry weight, i.e., excluding any water that may be present in the detergent composition. Percentages of monomer units in the polymer are percentages of solids weight, i.e., excluding any water present in a polymer emulsion.

Preferably, the first polymer comprises at least 65 wt % polymerized units of a $C_3$-$C_6$ monoethylenically unsaturated carboxylic acid, preferably at least 68 wt %, preferably at least 70 wt %, preferably at least 72 wt %, preferably at least 74 wt %, preferably at least 76 wt %; preferably no more than 83 wt %, preferably no more than 81 wt %. Preferably, the $C_3$-$C_6$ monoethylenically unsaturated carboxylic acid is selected from the group consisting of (meth)acrylic acid and crotonic acid; preferably (meth)acrylic acid. Preferably, the $C_3$-$C_6$ monoethylenically unsaturated dicarboxylic acid units are at least 3 wt % of the first polymer, preferably at least 4 wt %, preferably at least 5 wt %; preferably no more than 27 wt %, preferably no more than 25 wt %, preferably no more than 23 wt %. Preferably, the $C_3$-$C_6$ monoethylenically unsaturated dicarboxylic acid is selected from the group consisting of maleic acid, fumaric acid, itaconic acid, mesaconic acid and citraconic acid; preferably maleic acid or itaconic acid.

Preferably, the first polymer comprises at least 4 wt % of a $C_5$-$C_{12}$ monoethylenically unsaturated tertiary amine, preferably at least 8 wt %, preferably at least 10 wt %; preferably no more than 14 wt %, preferably no more than 13 wt %, preferably no more than 12 wt %. Preferably, the $C_5$-$C_{12}$ monoethylenically unsaturated tertiary amine is a (meth)acrylate ester or a (meth)acrylamide, preferably containing a dialkylamino group in which the sum of the carbon numbers of the two alkyl groups is less than 7, preferably less than 5. Preferably, the monoethylenically unsaturated tertiary amine has from seven to twelve carbon atoms, preferably seven to ten. Preferably, the monoethylenically unsaturated tertiary amine contains only carbon, hydrogen, oxygen and nitrogen atoms; preferably it has no hydroxyl or carboxyl substituents. Preferably, the monoethylenically unsaturated tertiary amine contains a dimethylamino group bonded to an ethyl or propyl group. Especially preferred monoethylenically unsaturated tertiary amines include 2-(dimethylamino)ethyl (meth)acrylate, N-(3-dimethylaminopropyl) (meth)acrylamide, 2-(diethylamino)ethyl (meth) acrylate, 2-(diisopropylamino)ethyl (meth)acrylate; preferably 2-(dimethylamino)ethyl methacrylate (DMAEMA), 2-(diethylamino)ethyl (meth)acrylate (DEAEMA) and N-(3-dimethylaminopropyl) methacrylamide (DMAPMA); preferably DMAEMA, DMAPMA or DEAEMA.

Preferably, the first polymer has $M_w$ of at least 4,000, preferably at least 5,000; preferably no more than 70,000, preferably no more than 50,000, preferably no more than 30,000, preferably no more than 25,000, preferably no more than 20,000, preferably no more than 16,000.

Preferably, the composition comprises at least 2.8 wt % of the first polymer, preferably at least 3 wt %, preferably at least 3.2 wt %, preferably at least 3.4 wt %, preferably at least 3.6 wt %, preferably at least 3.8 wt %, preferably at least 3.9 wt %; preferably no more than 7 wt %, preferably no more than 6.5 wt %, preferably no more than 6 wt %, preferably no more than 5.5 wt %.

In a preferred embodiment, the composition comprises (a) 2.2 to 8 wt % of a first polymer comprising polymerized units of: (i) 55 to 85 wt % of a $C_3$-$C_6$ monoethylenically unsaturated carboxylic acid, (ii) 2 to 30 wt % of a $C_3$-$C_6$ monoethylenically unsaturated dicarboxylic acid and (iii) 2 to 15 wt % of a $C_5$-$C_{12}$ monoethylenically unsaturated tertiary amine; and having $M_w$ from 2,000 to 100,000; and (b) 0.5 to 7 wt % of a second polymer comprising polymerized units of: (i) 60 to 95 wt % of a $C_3$-$C_6$ monoethylenically unsaturated carboxylic acid, and (ii) 5 to 40 wt % of a monoethylenically unsaturated sulfonic acid; and having $M_w$ from 5,000 to 100,000.

Preferably the first and second polymers are present in a weight ratio (first:second) of 9:1 to 1:3, respectively; preferably 9:1 to 1:2, preferably 6:1 to 1:3, preferably 6:1 to 1:2, preferably 6:1 to 1:1.5, preferably 6:1 to 1:1, preferably 6:1 to 1.5:1, preferably 4:1 to 1:1. Preferably, the total amount of first and second polymers in the composition is from 3 to 12 wt %, preferably at least 3.3 wt %, preferably at least 3.6 wt %; preferably no more than 10 wt %, preferably no more than 8 wt %, preferably no more than 6 wt %, preferably no more than 5 wt %. Preferably, the composition comprising the first and second polymers comprises at least 2.2 wt % of the first polymer, preferably at least 2.3 wt %, preferably at least 2.4 wt %, preferably at least 2.5 wt %, preferably at least 2.6 wt %, preferably at least 2.7 wt %, preferably at least 2.8 wt %; preferably no more than 7 wt %, preferably no more than 6.5 wt %, preferably no more than 6 wt %, preferably no more than 5.5 wt %, preferably no more than 5 wt %. Preferably, the composition comprising the first and second polymers comprises at least 0.7 wt % of the second polymer, preferably at least 0.9 wt %, preferably at least 1.2 wt %, preferably at least 1.5 wt %, preferably at least 1.8 wt %; preferably no more than 6 wt %, preferably no more than 5.5 wt %, preferably no more than 5 wt %, preferably no more than 4.5 wt %, preferably no more than 4 wt %.

For both the first and second polymers, in cases where the monoethylenically unsaturated dicarboxylic acid is available in the form of an anhydride, the polymer is made by polymerizing the anhydride, which is hydrolyzed to the acid during the polymerization process, resulting in a polymerized unit of a monoethylenically unsaturated dicarboxylic acid. All references to polymerized dicarboxylic acid units in the polymers include metal salts of the acid which would be present at pH values near or above the pKa of the carboxylic acid groups. Preferably, the monoethylenically unsaturated dicarboxylic acid has from four to six carbon atoms, preferably four or five. Preferably, the monoethylenically unsaturated dicarboxylic acid is selected from the group consisting of maleic acid, fumaric acid, itaconic acid, mesaconic acid and citraconic acid; preferably maleic acid or itaconic acid; preferably maleic acid.

Preferably the monoethylenically unsaturated sulfonic acid has from five to twelve carbon atoms; preferably it contains an acrylamido or methacryamido group. Especially preferred monoethylenically unsaturated sulfonic acids include 2-acrylamido-2-methylpropanesulfonic acid (AMPS), sulfopropyl (meth)acrylate, sulfomethylated acrylamide, allyl sulfonic acid, styrene sulfonic acid and vinyl sulfonic acid; preferably AMPS. These monomers can be used in their acid forms or in the form of their monovalent metal ion salts.

Preferably, the second polymer comprises polymerized units which are at least 63 wt % (meth)acrylic acid, preferably at least 66 wt %, preferably at least 69 wt %; preferably no more than 85 wt %, preferably no more than 80 wt %, preferably no more than 77 wt %. Preferably, the second polymer comprises at least 15 wt % polymerized units of monoethylenically unsaturated sulfonic acid residues (including metal or ammonium salts), preferably at least 20 wt %, preferably at least 23 wt %; preferably no more than 37 wt %, preferably no more than 34 wt %, preferably no more than 31 wt %.

Preferably, neither polymer contains more than 8 wt % polymerized units of esters of acrylic or methacrylic acid, preferably no more than 5 wt %, preferably no more than 3 wt %, preferably no more than 1 wt %.

Preferably, the second polymer has $M_w$ of at least 10,000; preferably no more than 70,000, preferably no more than 50,000, preferably no more than 30,000, preferably no more than 25,000, preferably no more than 20,000.

The polymer may be used in combination with other polymers useful for controlling insoluble deposits in automatic dishwashers, including, e.g, polymers comprising combinations of residues of acrylic acid, methacrylic acid, maleic acid or other diacid monomers, esters of acrylic or methacrylic acid including polyethylene glycol esters, styrene monomers, AMPS and other sulfonated monomers, and substituted acrylamides or methacrylamides.

Preferably, the detergent composition comprises citrate in an amount from 5 to 45 wt %; preferably at least 6 wt %, preferably at least 8 wt %, preferably at least 10 wt %, preferably at least 12 wt %; preferably no more than 40 wt %, preferably no more than 35 wt %, preferably no more than 30 wt %, preferably no more than 25 wt %, preferably no more than 20 wt %, preferably no more than 18 wt %. Preferably, the detergent composition comprises carbonate in an amount from 15 to 50 wt %; preferably at least 20 wt %, preferably at least 22 wt %, preferably at least 24 wt %; preferably no more than 45 wt %, preferably no more than 40 wt %, preferably no more than 36 wt %, preferably no more than 33 wt %. Preferably, the detergent composition comprises percarbonate and/or perborate (preferably percarbonate) in an amount from 5 to 45 wt %. Preferably, the amount of percarbonate and/or perborate is at least 6 wt %, preferably at least 8 wt %, preferably at least 10 wt %, preferably at least 12 wt %; preferably no more than 40 wt %, preferably no more than 35 wt %, preferably no more than 30 wt %, preferably no more than 25 wt %, preferably no more than 20 wt %, preferably no more than 18 wt %.

Preferably, the detergent composition comprises an aminocarboxylate builder, preferably in an amount from 1 to 35 wt %; preferably at least 1.5 wt %, preferably at least 2 wt %, preferably at least 5 wt %, preferably at least 10 wt %; preferably no more than 30 wt %, preferably no more than 25 wt %, preferably no more than 20 wt %. A preferred aminocarboxylate builder is methylglycinediacetic acid (MGDA).

The polymer of this invention may be produced by any of the known techniques for polymerization of acrylic monomers. Preferably, the initiator does not contain phosphorus. Preferably, the polymer contains less than 1 wt % phosphorus, preferably less than 0.5 wt %, preferably less than 0.1 wt %, preferably the polymer contains no phosphorus. Preferably, polymerization is initiated with persulfate and the end group on the polymer is a sulfate or sulfonate. The polymer may be in the form of a water-soluble solution polymer, slurry, dried powder, or granules or other solid forms.

Other components of the automatic dishwashing detergent composition may include, e.g., surfactants, oxygen and/or chlorine bleaches, bleach activators, enzymes, foam suppressants, colors, fragrances, antibacterial agents and fillers. Typical surfactant levels depend on the particular surfactant(s) used; preferably the total amount of surfactants is from 0.5 wt % to 15 wt %, preferably at least 0.7 wt %, preferably at least 0.9 wt %; preferably no more than 10 wt %, preferably no more than 7 wt %, preferably no more than 4 wt %, preferably no more than 2 wt %, preferably no more than 1 wt %. Preferably, the surfactant comprises a nonionic surfactant. Preferably, nonionic surfactants have the formula $RO\text{-}(M)_x\text{-}(N)_y\text{—}OH$ or $R\text{—}O\text{-}(M)_x\text{-}(N)_y\text{—}O\text{—}R'$ in which M and N are units derived from alkylene oxides (of which one is ethylene oxide), R represents a $C_6$-$C_{22}$ linear or branched alkyl group, and R' represents a group derived from the reaction of an alcohol precursor with a $C_6$-$C_{22}$ linear or branched alkyl halide, epoxyalkane, or glycidyl ether. Fillers in tablets or powders are inert, water-soluble substances, typically sodium or potassium salts, e.g., sodium or potassium sulfate and/or chloride, and typically are present in amounts ranging from 0 wt % to 70 wt %, preferably from 10 to 50 wt %, preferably from 15 to 35 wt %. Fillers in gel formulations may include those mentioned above and also water. Fragrances, dyes, foam suppressants, enzymes and antibacterial agents usually total no more than 5 wt % of the composition.

Preferably, the composition has a pH (at 1 wt % in water) of at least 10, preferably at least 11.5; in some embodiments the pH is no greater than 13.

The composition can be formulated in any typical form, e.g., as a tablet, powder, monodose, sachet, paste, liquid or gel. The composition can be used under typical operating conditions for any typical automatic dishwasher. Typical water temperatures during the washing process preferably are from 20° C. to 85° C., preferably from 30° C. to 70° C. Typical concentrations for the composition as a percentage of total liquid in the dishwasher preferably are from 0.1 to 1 wt %, preferably from 0.2 to 0.7 wt %. With selection of an appropriate product form and addition time, the composition may be present in the prewash, main wash, penultimate rinse, final rinse, or any combination of these cycles.

Abbreviations Used in these Examples

AA acrylic acid
ADW automatic dishwashing
AMPS 2-acrylamido-2-methyl-1-propanesulfonic acid, sodium salt
DEAEMA 2-(diethylamino)ethyl methacrylate
DMAEMA 2-(dimethylamino)ethyl methacrylate
DMAPMA N-[3-(dimethylamino)propyl]methacrylamide
IA itaconic acid
MAA methacrylic acid
Mal maleic acid
MGDA methylglycinediacetic acid, sodium salt
Mn number-average molecular weight
Mw weight-average molecular weight
SMBS sodium metabisulfite
SPS sodium persulfate
TAED tetraacetylethylenediamine

EXAMPLES

Synthesis of Polymer C

To a round-bottom glass flask equipped with nitrogen bubbler, reflux condenser, heating mantle, thermocouple, and overhead mixer were added maleic anhydride (35 g), deionized water (275 g), and 3.32 g of a 0.15 wt % solution of ferrous sulfate in water. The temperature of the reaction mixture was raised to 78° C. This temperature was maintained until noted below. Upon reaching this temperature, a solution of SMBS (2.7 g in 7 g deionized water) was charged. Feeds of (A) a mixture of AA (320 g) and DMAEMA (39 g); (B) a solution of SMBS (57.3 g in 100 g deionized water); and (C) a solution of SPS (2.95 g in 30 g deionized water) were started simultaneously. Solution A was fed so that it would be exhausted after 90 min Solution B was fed so that it would be exhausted after 80 min. Solution C was fed so that it would be exhausted after 85 min. Ten minutes after the cessation of the feed of Solution A, feed of a first chase solution of SPS (0.53 g in 15 g deionized water) was started and was complete after 10 min. Twenty minutes after the completion of the first chase, an identical solution was added over the course of another 10 min. Twenty minutes after the completion of the second chase, the temperature was allowed to fall to 60° C. and a first neutralizer solution of 100 g sodium hydroxide (50%) was added, followed by 1.5 g hydrogen peroxide solution (35%) and a second neutralizer solution of 180 g sodium hydroxide (50%). Finally 50 g deionized water was added. The solution contained 44.4 wt % solid content (residue remaining after drying in forced air oven at 150° C.), had a pH of 6.33, a viscosity (Brookfield) of 370, and Mw=5,743, Mn=1,166 by GPC. Residual AA of 481 ppm and residual Mal of 0 ppm were detected by liquid chromatography.

Other polymers were made using the same process but adjusting the levels of chain-transfer agent (SMBS) and monomers as appropriate.

Preparation of Food Soil:

| Ingredients | Wt., g |
|---|---|
| Water | 700.0 |
| Instant Gravy | 25.0 |
| Starch | 5.0 |
| Benzoic Acid | 1.0 |
| Margarine | 100.0 |
| Milk (3.5% Fat) | 50.0 |
| Ketchup | 25.0 |
| Mustard | 25.0 |
| Egg yolk | 3.0 |
| Total: | 934.0 |

1. Bring water to a boil.
2. Mix in 16 oz (473 mL) paper cup: instant gravy, benzoic acid and starch; add this mixture to the boiling water.
3. Add milk and margarine.
4. Let the mixture cool down to approximately 40° C.
5. Fill the mixture into a bowl of Kitchen Machine (POLYTRON).
6. In a 16 oz paper cup, mix the egg yolk, ketchup and mustard using a spoon.
7. Add the cool down mixture to the bowl stirring continuously.
8. Let the mixture stir for 5 min.
9. Freeze the mixture.
10. The frozen slush is placed into the dishwasher prior to the starting program.

Conditions for Dishwashing Tests:

Machine: KENMORE SS-ADW, Model 15693
Wash program: Normal wash cycle with heated wash, fuzzy logic engaged, heated dry
Cycle time: ca. 2 h
Water hardness: 300 ppm as $CaCO_3$ (confirmed by EDTA Titration)
Ca:Mg (molar): 2:1
Tank water T, ° C.: 54
ADW basin initial T, ° C.: 43
Total detergent weight, g 20
Food soil: 50 g per cycle
Food soil charged when the detergent is charged to the wash liquor (20 min mark).
After drying in open air, two glasses were rated from 1 (clean) to 5 (heavily fouled) on both fouling and spotting by two trained observers. (See ASTM-D 3556-85.)

TABLE 1

Polymers used in auto-dishwashing examples

| poly-mer | Mon 1 (%) | Mon 2 (%) | Mon 3 (%) | Mw/ 1000 | Mw/ Mn | solids, % |
|---|---|---|---|---|---|---|
| A | AA (60) | Mal (20) | DMAEMA (20) | 13.9 | 10.3 | 42.6 |
| B | AA (72) | AMPS (28) | — | 16.5 | 4.0 | 92.0 |
| C | AA (80) | Mal (10) | DMAEMA (10) | 5.7 | 4.9 | 44.4 |
| D | AA (80) | Mal (10) | DMAEMA (10) | 30.4 | 9.8 | 44.0 |
| E | AA (70) | Mal (10) | DMAEMA (20) | 5.4 | 4.6 | 44.2 |
| F | AA (70) | Mal (20) | DMAEMA (10) | 10.1 | 10.8 | 42.1 |
| G | AA (80) | DMAEMA (20) | — | 7.3 | 2.9 | 44.6 |
| H | AA (90) | Mal (10) | — | 5.0 | 4.1 | 42.2 |
| I | AA (80) | Mal (10) | DMAEMA (10) | 6.2 | 5.4 | 43.0 |
| J | AA (85) | Mal (5) | DMAEMA (10) | 6.4 | 4.8 | 45.9 |
| K | AA (80) | IA (10) | DMAEMA (10) | 6.1 | 4.6 | 43.5 |
| L | MAA (80) | Mal (10) | DMAEMA (10) | 10.5 | 7.2 | 41.4 |
| M | AA (80) | Mal (10) | DMAPMA (10) | 6.7 | 5.6 | 44.2 |
| N | AA (80) | Mal (10) | DEAEMA (10) | 6.3 | 5.6 | 44.2 |

TABLE 2

ADW Examples 1: Polymer Composition Study.
Note: filming and spotting assessments were made after 10 cycles.

| | Ex. 1 | Ex. 2 | Ex. 3 | Comp. Ex. 1 | Comp. Ex. 2 | Comp. Ex. 3 |
|---|---|---|---|---|---|---|
| Sodium Citrate, % | 15 | 15 | 15 | 15 | 15 | 15 |
| Sodium Carbonate, % | 30 | 30 | 30 | 30 | 30 | 30 |
| Sodium Percarbonate, % | 15 | 15 | 15 | 15 | 15 | 15 |
| TAED, % | 4 | 4 | 4 | 4 | 4 | 4 |
| DOWFAX ™ 20B102, % | 0.4 | 0.4 | 0.4 | 0.4 | 0.4 | 0.4 |
| AMMONYX ™ LMDO, %[a] | 1.6 | 1.6 | 1.6 | 1.6 | 1.6 | 1.6 |
| Polymer A, % | 0 | 0 | 0 | 2.6 | 0 | 0 |
| Polymer B, % | 1.4 | 1.4 | 1.4 | 1.4 | 4.0 | 1.4 |
| Polymer C, % | 2.6 | 0 | 0 | 0 | 0 | 1 |
| Polymer D, % | 0 | 2.6 | 0 | 0 | 0 | 0 |
| Polymer E, % | 0 | 0 | 0 | 0 | 0 | 2.6 |
| Polymer F, % | 0 | 0 | 2.6 | 0 | 0 | 0 |
| α-Amylase from Bacillus, % | 1 | 1 | 1 | 1 | 1 | 1 |
| Protease from Bacillus, % | 2 | 2 | 2 | 2 | 2 | 2 |
| Sodium disilicate[b], % | 2 | 2 | 2 | 2 | 2 | 2 |
| Sodium Sulfate, % | 25 | 25 | 25 | 25 | 25 | 25 |
| Total Wt % | 100 | 100 | 100 | 100 | 100 | 100 |
| Filming (Obs. 1, Glass 1) | 1.2 | 3.5 | 1.8 | 1.6 | 1.2 | 1.2 |
| Filming (Obs. 1, Glass 2) | 1.8 | 2.8 | 2.0 | 1.9 | 2.0 | 2.0 |
| Filming (Obs. 2, Glass 1) | 1.2 | 3.5 | 1.5 | 1.6 | 1.2 | 1.2 |
| Filming (Obs. 2, Glass 2) | 1.8 | 2.8 | 2.1 | 1.9 | 2.0 | 2.0 |
| Average Filming Rating | 1.5 | 3.2 | 1.9 | 1.8 | 1.6 | 1.6 |
| Spotting (Obs. 1, Glass 1) | 2.5 | 1.5 | 2.5 | 2.5 | 4.0 | 3.5 |

TABLE 2-continued

ADW Examples 1: Polymer Composition Study.
Note: filming and spotting assessments were made after 10 cycles.

| | Ex. 1 | Ex. 2 | Ex. 3 | Comp. Ex. 1 | Comp. Ex. 2 | Comp. Ex. 3 |
|---|---|---|---|---|---|---|
| Spotting (Obs. 1, Glass 2) | 2.5 | 2.2 | 2.6 | 2.5 | 4.2 | 5.0 |
| Spotting (Obs. 2, Glass 1) | 3.0 | 2.0 | 2.0 | 3.0 | 4.0 | 4.0 |
| Spotting (Obs. 2, Glass 2) | 2.7 | 2.2 | 2.7 | 3.5 | 5.0 | 5.0 |
| Average Rating | 2.7 | 2.0 | 2.5 | 2.9 | 4.3 | 4.4 |

[a]Stepan Co.;
[b]BRITESIL H 20, PQ Corp.

TABLE 3

ADW Examples 2: Blend Ratio Study
Note: filming and spotting assessments were made after 10 cycles.

| | Ex. 4 | Comp. Ex. 4 | Comp. Ex. 5 | Comp. Ex. 6 | Comp. Ex. 7 |
|---|---|---|---|---|---|
| Sodium Citrate, % | 15 | 15 | 15 | 15 | 15 |
| Sodium Carbonate, % | 30 | 30 | 30 | 30 | 30 |
| Sodium Percarbonate, % | 15 | 15 | 15 | 15 | 15 |
| TAED, % | 4 | 4 | 4 | 4 | 4 |
| DOWFAX ™ 20B102, % | 0.4 | 0.4 | 0.4 | 0.4 | 0.4 |
| AMMONYX ™ LMDO, %[a] | 1.6 | 1.6 | 1.6 | 1.6 | 1.6 |
| Polymer B, % | 1.0 | 2.0 | 3.0 | 0 | 4.0 |
| Polymer C, % | 3.0 | 2.0 | 1.0 | 0 | 0 |
| Polymer G, % | 0 | 0 | 0 | 2.0 | 0 |
| Polymer H, % | 0 | 0 | 0 | 2.0 | 0 |
| α-Amylase from *Bacillus*, % | 1 | 1 | 1 | 1 | 1 |
| Protease from *Bacillus*, % | 2 | 2 | 2 | 2 | 2 |
| Sodium disilicate[b], % | 2 | 2 | 2 | 2 | 2 |
| Sodium Sulfate, % | 25 | 25 | 25 | 25 | 25 |
| Total Wt % | 100 | 100 | 100 | 100 | 100 |
| Filming (Obs. 1, Glass 1) | 1.8 | 1.8 | 1.2 | 3.0 | 1.5 |
| Filming (Obs. 1, Glass 2) | 2.1 | 2.0 | 1.8 | 2.4 | 1.9 |
| Filming (Obs. 2, Glass 1) | 1.8 | 1.5 | 1.5 | 3.2 | 1.5 |
| Filming (Obs. 2, Glass 2) | 2.2 | 2.0 | 1.8 | 2.5 | 1.9 |
| Average Filming Rating | 2.0 | 1.8 | 1.6 | 2.8 | 1.7 |
| Spotting (Obs. 1, Glass 1) | 1.8 | 3.0 | 4.0 | 2.2 | 4.0 |
| Spotting (Obs. 1, Glass 2) | 2.2 | 3.8 | 5.0 | 2.7 | 4.5 |
| Spotting (Obs. 2, Glass 1) | 1.6 | 2.5 | 4.5 | 2.5 | 3.5 |
| Spotting (Obs. 2, Glass 2) | 2.8 | 4.2 | 5.0 | 3.1 | 4.7 |
| Average Rating | 2.1 | 3.4 | 4.6 | 2.6 | 4.2 |

[a]Stepan Co.;
[b]BRITESIL H 20, PQ Corp.

TABLE 4

ADW Examples 3: Compositional and MW Variation.
Note: filming and spotting assessments were made after 15 cycles[b].

| | Ex. 5 | Ex. 6 | Ex. 7 | Ex. 8 | Ex. 9 | Ex. 10 |
|---|---|---|---|---|---|---|
| Sodium Citrate, % | 15 | 15 | 15 | 15 | 15 | 15 |
| Sodium Carbonate, % | 30 | 30 | 30 | 30 | 30 | 30 |
| Sodium Percarbonate, % | 15 | 15 | 15 | 15 | 15 | 15 |
| TAED, % | 4 | 4 | 4 | 4 | 4 | 4 |
| TRITON ™ DF-16 | 1.5 | 1.5 | 1.5 | 1.5 | 1.5 | 1.5 |
| TERGITOL ™ L61 | 0.5 | 0.5 | 0.5 | 0.5 | 0.5 | 0.5 |
| Polymer B, % | 2.0 | 2.0 | 2.0 | 2.0 | 2.0 | 2.0 |
| Polymer I, % | 2.0 | 0 | 0 | 0 | 0 | 0 |
| Polymer J, % | 0 | 2.0 | 0 | 0 | 0 | 0 |
| Polymer K, % | 0 | 0 | 2.0 | 0 | 0 | 0 |
| Polymer L, % | 0 | 0 | 0 | 2.0 | 0 | 0 |

TABLE 4-continued

ADW Examples 3: Compositional and MW Variation.
Note: filming and spotting assessments were made after 15 cycles[b].

| | Ex. 5 | Ex. 6 | Ex. 7 | Ex. 8 | Ex. 9 | Ex. 10 |
|---|---|---|---|---|---|---|
| Polymer M, % | 0 | 0 | 0 | 0 | 2.0 | 0 |
| Polymer N, % | 0 | 0 | 0 | 0 | 0 | 2.0 |
| α-Amylase from Bacillus, % | 1 | 1 | 1 | 1 | 1 | 1 |
| Protease from Bacillus, % | 2 | 2 | 2 | 2 | 2 | 2 |
| Sodium disilicate[a], % | 2 | 2 | 2 | 2 | 2 | 2 |
| Sodium Sulfate, % | 25 | 25 | 25 | 25 | 25 | 25 |
| Total Wt % | 100 | 100 | 100 | 100 | 100 | 100 |
| Filming Rating (Obs. 1, Glass 1) | 1.5 | 1.5 | 2.0 | 4.0 | 1.5 | 2.0 |
| Filming Rating (Obs. 2, Glass 1) | 2.0 | 2.1 | 1.9 | 3.4 | 1.9 | 2.0 |
| Filming Rating (Obs. 1, Glass 2) | 1.5 | 1.5 | 1.5 | 4.0 | 1.5 | 1.5 |
| Filming Rating (Obs. 2, Glass 2) | 2.2 | 2.2 | 2.2 | 3.4 | 2.2 | 2.3 |
| Average Filming Rating | 1.8 | 1.8 | 1.9 | 3.7 | 1.8 | 2.0 |
| Spotting Rating (Obs. 1, Glass 1) | 4.0 | 3.5 | 3.5 | 1.5 | 3.0 | 3.5 |
| Spotting Rating (Obs. 2, Glass 1) | 2.6 | 2.6 | 2.8 | 1.5 | 2.6 | 2.8 |
| Spotting Rating (Obs. 1, Glass 2) | 4.0 | 3.5 | 3.5 | 1.5 | 3.0 | 4.0 |
| Spotting Rating (Obs. 2, Glass 2) | 2.7 | 2.6 | 2.8 | 1.7 | 2.6 | 2.8 |
| Average Spotting Rating | 3.3 | 3.1 | 3.2 | 1.6 | 2.8 | 3.3 |

[a]Britesil ™ H 20, PQ Corp.

[b]Data from this table cannot be compared directly with those in Tables 2 and 3, which were obtained after 10 cycles

TABLE 5

ADW Examples 4: Performance in Citrate-Based Formulations (Comparison with Controls).
Note: filming and spotting assessments were made after 10 cycles.

| | Comp. Ex. 8 | Ex. 11 | Ex. 12 | Ex. 13 | Comp. Ex. 9 |
|---|---|---|---|---|---|
| Sodium Citrate, % | 15 | 15 | 15 | 15 | 15 |
| Sodium Carbonate, % | 30 | 30 | 30 | 30 | 30 |
| Sodium Percarbonate, % | 15 | 15 | 15 | 15 | 15 |
| TAED, % | 4 | 4 | 4 | 4 | 4 |
| DOWFAX ™ 20B102 | 1.5 | 1.5 | 1.5 | 1.5 | 1.5 |
| AMMONYX ™ LMDO | 0.5 | 0.5 | 0.5 | 0.5 | 0.5 |
| TERGITOL ™ L61 | 0 | 0 | 0 | 0.5 | 0.5 |
| TRITON ™ DF-16 | 0 | 0 | 0 | 1.5 | 1.5 |
| Polymer B, % | 4 | 0 | 2 | 0 | 4 |
| Polymer C, % | 0 | 4 | 2 | 0 | 0 |
| Polymer I, % | 0 | 0 | 0 | 4 | 0 |
| α-Amylase from *Bacillus*, % | 1 | 1 | 1 | 1 | 1 |
| Protease from *Bacillus*, % | 2 | 2 | 2 | 2 | 2 |

TABLE 5-continued

ADW Examples 4: Performance in Citrate-Based Formulations (Comparison with Controls).
Note: filming and spotting assessments were made after 10 cycles.

| | Comp. Ex. 8 | Ex. 11 | Ex. 12 | Ex. 13 | Comp. Ex. 9 |
|---|---|---|---|---|---|
| Sodium disilicate[a], % | 2 | 2 | 2 | 2 | 2 |
| Sodium Sulfate, % | 25 | 25 | 25 | 25 | 25 |
| Total Wt % | 100 | 100 | 100 | 100 | 100 |
| Average Filming Rating | 1.8 | 3.1 | 1.9 | 4.1 | 1.9 |
| Average Spotting Rating | 3.6 | 1.4 | 2.3 | 1.2 | 3.5 |

[a]Britesil ™ H 20, PQ Corp.

A separate set of assessments revealed that the first polymer, when used in the absence of the second polymer, resulted in a slight blue film on the glasses. In the present work, the blue film was not visible when the first and second polymers were used together.

The invention claimed is:

1. A phosphorus-free automatic dishwashing detergent composition comprising (a) 2.5 to 5.5 wt % of a first polymer comprising polymerized units of:

(i) 76 to 85 wt % (meth)acrylic acid;

(ii) 5 to 23 wt % of a $C_3$-$C_6$ monoethylenically unsaturated dicarboxylic acid, wherein the $C_3$-$C_6$ monoethylenically unsaturated dicarboxylic acid is selected from the group consisting of maleic acid, fumaric acid, itaconic acid, mesaconic acid and citraconic acid; and (iii) 8 to 15 wt % of a $C_5$-$C_{12}$ monoethylenically unsaturated tertiary amine selected from the group consisting of 2-(dimethylamino)ethyl methacrylate; 2-(diethylamino)ethyl (meth)acrylate and N-(3-dimethylaminopropyl) methacrylamide; and having $M_w$ from 2,000 to 30,000; and (b) 1.2 to 4 wt % of a second polymer comprising polymerized units of: (i) 60 to 95 wt % of a $C_3$-$C_6$ monoethylenically unsaturated carboxylic acid, and (ii) 5 to 40 wt % of a monoethylenically unsaturated sulfonic acid; and having $M_w$ from 10,000 to 25,000.

2. The composition of claim 1 in which said first polymer has $M_w$ from 2,000 to 25,000.

3. The composition of claim 1 in which said second polymer comprises polymerized units of: (i) 66 to 80 wt % of the $C_3$-$C_6$ monoethylenically unsaturated carboxylic acid, and (ii) 20 to 34 wt % of the monoethylenically unsaturated sulfonic acid.

4. The composition of claim 3 in which the composition comprises from 5 to 45 wt % citrate, from 15 to 50 wt % carbonate, from 5 to 45 wt % of at least one of percarbonate and perborate and less than 0.2 wt % phosphorus.

5. The composition of claim 1 in which said monoethylenically unsaturated sulfonic acid is 2-acrylamido-2-methylpropanesulfonic acid.

* * * * *